US006879292B2

(12) United States Patent
Shikata et al.

(10) Patent No.: US 6,879,292 B2
(45) Date of Patent: Apr. 12, 2005

(54) PATCH ANTENNA HAVING SUPPRESSED DEFECTIVE ELECTRICAL CONTINUITY

(75) Inventors: Masaru Shikata, Fukushima-ken (JP); Tadaaki Onishi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/705,123

(22) Filed: Nov. 10, 2003

(65) Prior Publication Data

US 2004/0095279 A1 May 20, 2004

(30) Foreign Application Priority Data

Nov. 13, 2002 (JP) ..... 2002-329528

(51) Int. Cl.[7] ..... H01Q 1/38
(52) U.S. Cl. ..... 343/700 MS
(58) Field of Search ..... 343/700 MS, 829, 343/830, 846

(56) References Cited

U.S. PATENT DOCUMENTS 4,386,357 A * 5/1983 Patton ..... 343/700 MS
4,414,550 A * 11/1983 Tresselt ..... 343/700 MS
4,660,048 A * 4/1987 Doyle ..... 343/700 MS
6,037,903 A * 3/2000 Lange et al. ..... 343/700 MS
6,507,316 B2 * 1/2003 Mendelsohn et al. 343/700 MS
2004/0021606 A1 * 2/2004 Shigihara ..... 343/700 MS

FOREIGN PATENT DOCUMENTS

JP 09-008537 1/1997
JP 09-260933 10/1997

* cited by examiner

*Primary Examiner*—Tho Phan
(74) *Attorney, Agent, or Firm*—Brinks Hofer Gilson & Lione

(57) ABSTRACT

A patch antenna includes a dielectric substrate having a through-hole, a patch electrode on the dielectric substrate, and a feed pin inserted in the through-hole. A head of the feed pin is soldered to the patch electrode. The bottom surface of the head of the feed pin has projections for generating a clearance between the bottom surface of the head and the opposing surface of the patch electrode, which is filled with a solder. The solder can function as a cushion that prevents a thermal contraction or a thermal expansion of the head of the feed pin to directly affect the dielectric substrate.

3 Claims, 2 Drawing Sheets

PATCH ANTENNA HAVING SUPPRESSED DEFECTIVE ELECTRICAL CONTINUITY

BACKGROUND OF THE INVENTION

1. Field of the Invention

The present invention relates to a patch antenna in which a feed pin for feeding is soldered to a patch electrode on a dielectric substrate and, in particular, to a solder joint structure of the feed pin.

2. Description of the Related Art

In recent years, in accordance with the widespread use of wireless communication systems, such as Global Positioning Systems (GPS) and Electronic Toll Collection systems (ETC), a demand for patch antennas, which are planar and ultra-compact, has been growing. Such a patch antenna has a patch electrode made of copper or silver on a ceramic dielectric substrate. A given high-frequency signal is fed to the patch electrode to resonate so that the patch antenna transmits and receives a signal wave in the resonance frequency band. In general, a ground conductor plate is attached to the bottom surface of the dielectric substrate, which is disposed on a circuit board having a low noise amplifier (LNA). Feeding to the patch electrode is carried out via a feed pin, for example, shown in FIG. 5.

Referring to FIG. 5, a through-hole 2*a* is formed at the position corresponding to a feeding point of a patch electrode 3 in the dielectric substrate 2 of the patch antenna 1. A feed pin 4 is inserted into the through-hole 2*a* and a head 4*a* of the feed pin 4 is coupled to the patch electrode 3 with a solder 5 electrically and mechanically. The feed pin 4 is made of metal having high electrical conductivity, such as brass. The bottom end of the feed pin 4 (not shown) extends through a circuit board (not shown), which mounts the patch antenna, and is soldered to a low noise amplifier on the bottom surface of the circuit board. The head 4*a* of the feed pin 4 is a flat plate. The head 4*a* is disposed on the patch electrode 3 and soldered thereto, as is disclosed in, for example, Japanese Unexamined Patent Application Publication No. 9-8537 (page 3 and FIG. 1 of the cited document).

Referring to FIG. 5 showing the known patch antenna 1, there is a significant difference in the coefficients of thermal expansion between the dielectric substrate 2 made of ceramic and the feed pin 4 made of brass. Consequently, a significant change of environmental temperature causes deformation of the dielectric substrate 2 due to thermal contraction or thermal expansion of the head 4*a* of the feed pin 4. Reaction force to recover from the deformation acts on the solder 5 as shearing stress. If the patch antenna 1 stays for a long time in an environment where temperature variation is significant and thus thermal contraction or thermal expansion of the head 4*a* of the feed pin 4 frequently occurs, a crack in the solder 5 is produced to push up the head 4*a* from the patch electrode 3, causing defective electrical continuity between the feed pin 4 and the patch electrode 3. Such a defective soldered joint of the feed pin 4 and the patch electrode 3 due to the temperature variation particularly occurs in a low temperature environment.

SUMMARY OF THE INVENTION

Accordingly, it is an object of the present invention to provide a highly reliable patch antenna having suppressed defective electrical continuity between a feed pin and a patch electrode even in an environment where temperature variation is significant.

A patch antenna according to the present invention includes a dielectric substrate having a through-hole, a patch electrode on the dielectric substrate, and a feed pin inserted in the through-hole. A head of the feed pin is soldered to the patch electrode. The bottom surface of the head has projections for generating a clearance between the bottom surface of the head and the opposing surface of the patch electrode and the clearance is filled with a solder.

In this patch antenna, putting projections protruding from the bottom surface of the head of the feed pin on the patch electrode generates the clearance between the opposing surfaces of the head and the patch electrode, which is filled with the solder. The solder can function as a cushion that prevents thermal contraction or thermal expansion of the head of the feed pin to directly affect the dielectric substrate. Therefore, even if the thermal contraction or the thermal expansion of the head of the feed pin due to a temperature variation frequently occurs, no considerable deformation in the dielectric substrate, which causes a crack in the solder, is generated so that a defective solder joint of the feed pin and the patch electrode is suppressed. Thus, this structure provides a highly reliable patch antenna.

Preferably, in this structure, the projections are disposed at a plurality of positions apart from one another so that the clearance is readily filled with the solder. In addition, three of the projections are preferably disposed at even circumferential intervals on the bottom surface of the head so that the head can be fixed on the patch electrode.

DESCRIPTION OF THE PREFERRED EMBODIMENTS

Figure 1:
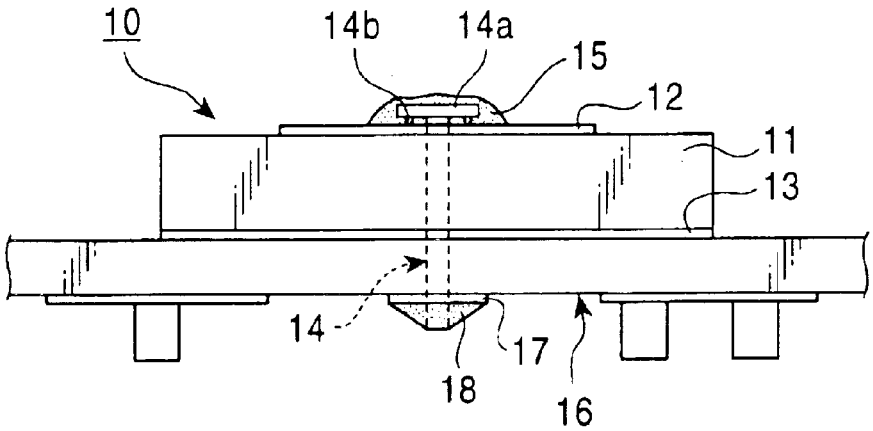
FIG. 1 is an explanatory view of the overall structure of a patch antenna according to an embodiment of the present invention.
Figure 2:
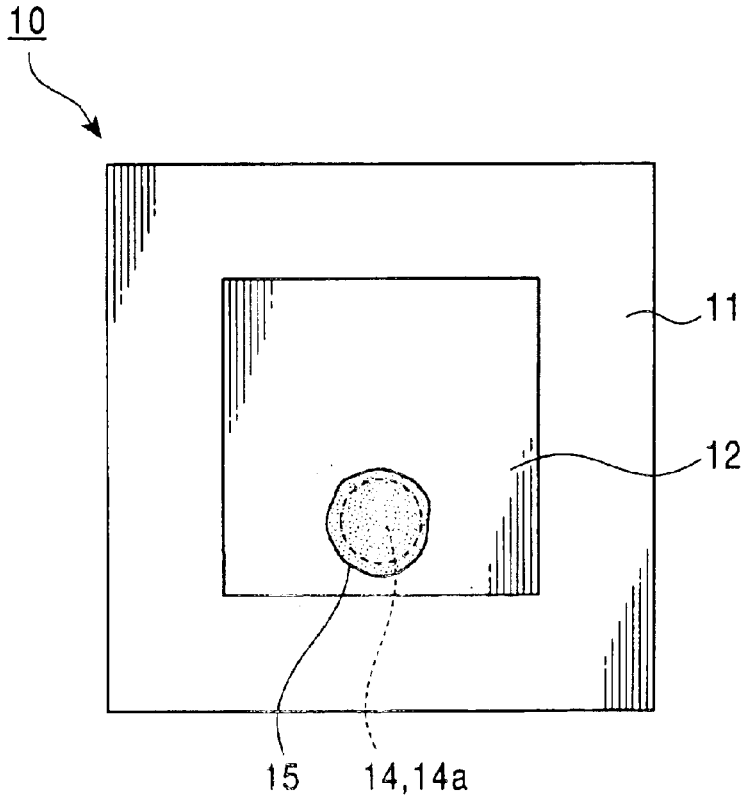
FIG. 2 is a plan view of the patch antenna shown in FIG. 1.
Figure 3:
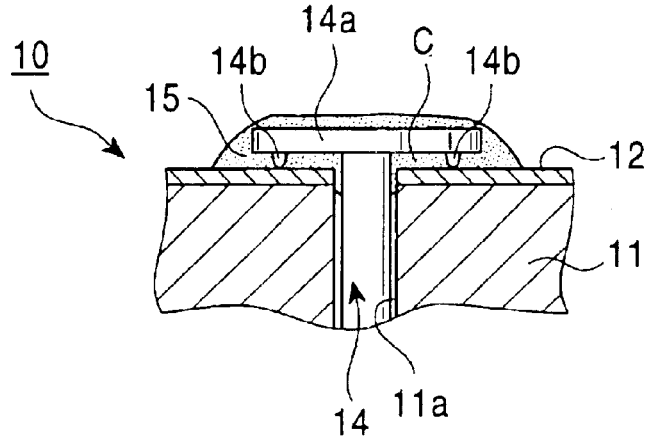
FIG. 3 is a partial sectional view near a feed pin of the patch antenna shown in FIG. 1.
Figure 4:
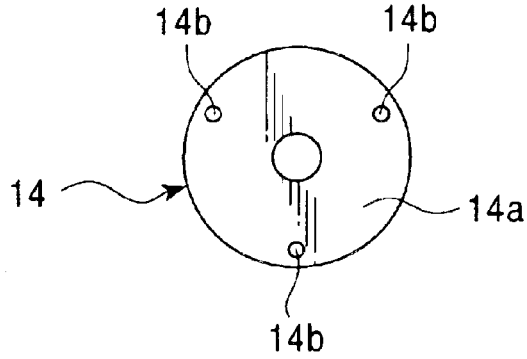
FIG. 4 is a bottom view of the feed pin of the patch antenna shown in FIG. 3.
Figure 5:
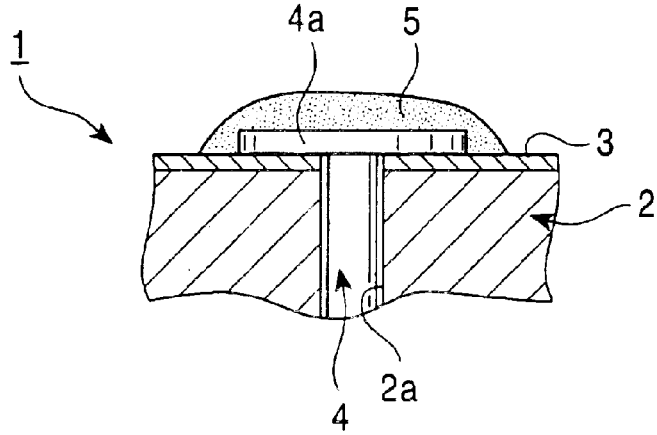
FIG. 5 PRIOR ART
FIG. 5 is a partial sectional view near a feed pin of a known patch antenna.

An embodiment according to the present invention will now be described with reference to the drawings. FIG. 1 is an explanatory view of the overall structure of a patch antenna according to the embodiment of the present invention. FIG. 2 is a plan view of the patch antenna. FIG. 3 is a partial sectional view near a feed pin of the patch antenna. FIG. 4 is a bottom view of the feed pin.

The patch antenna 10 shown in these drawings includes a dielectric substrate 11 having a through-hole 11*a*, a patch electrode 12 disposed on the dielectric substrate 11, a ground conductor plate 13 disposed on the bottom surface of the dielectric substrate 11, and a feed pin 14 inserted into the through-hole 11*a*. Ends of the feed pin 14 are soldered to the patch electrode 12 and a low noise amplifier 17, which is described below. A head 14*a* of the feed pin 14 is electrically and mechanically connected to the patch electrode 12 with a solder 15. The bottom surface of the head 14*a* has three projections 14*b* protruding substantially at even circumferential intervals as shown in FIG. 4, thus ensuring a clearance C, which can be filled with the solder 15, between the bottom surface of the head 14*a* and the opposing surface of the patch electrode 12, as shown in FIG. 3. The patch antenna 10 is mounted on a circuit board 16 that has the low noise amplifier 17 on the bottom surface. The end opposed to the head 14*a* of the feed pin 14 extends through the circuit board 16 and is electrically and mechanically connected to the low noise amplifier 17 with a solder 18.

In this patch antenna 10, given high-frequency signals are fed from the low noise amplifier 17 to the patch electrode 12 via the feed pin 14 to resonate the patch electrode 12 so that the patch antenna 10 can transmit and receive a linearly-polarized signal wave in the resonance frequency band.

Putting the three projections 14*b*, which protrude from the bottom surface of the head 14*a* of the feed pin 14, on the patch electrode 12 generates the clearance C between the opposing surfaces of the head 14*a* and the patch electrode 12. Since the clearance C is filled with the solder 15, deformation in the dielectric substrate 11 is reduced even if thermal contraction or thermal expansion of the head 14*a* of the feed pin 14 due to a temperature variation occurs. That is, since a solder material, such as a eutectic solder of lead and tin, has a relatively high elastic coefficient, the solder 15 in the clearance C can function as a cushion that prevents the thermal contraction or the thermal expansion of the head 14*a* of the feed pin 14 to directly affect the dielectric substrate 11. Therefore, in the patch antenna 10, if thermal contraction or thermal expansion of the head 14*a* of the feed pin 14 due to a temperature variation occurs, no considerable deformation in the dielectric substrate 11 is generated. As a result, cracking caused by a reaction force of the deformation is dramatically decreased. That is, the patch antenna 10 has a structure that suppresses a defective solder joint of the feed pin 14 and the patch electrode 12, thereby increasing reliability. In addition, realizing the increased reliability by the projections 14*b* on the head 14*a* of the feed pin 14 is cost-efficient.

In this embodiment, since the three projections 14*b* on the bottom surface of the head 14*a* of the feed pin 14 are disposed apart from one another, the clearance C is readily filled with the solder 15 and the head 14*a* can be fixed on the patch electrode 12.

The above-described patch antenna 10 has the patch electrode 12 which is rectangular in a plan view and functions as a linearly-polarized antenna; however, the patch electrode 12 may be circular. In case that a signal wave to be transmitted and received is a circularly-polarized wave, a patch electrode having a degeneracy separation element such as a notch is employed. Of course, the present invention may be applied to this case to improve the reliability.

What is claimed is:

1. A patch antenna comprising:

a dielectric substrate having a through-hole;

a patch electrode on the dielectric substrate; and a feed pin inserted in the through-hole, a head of the feed pin soldered to the patch electrode;

wherein a bottom surface of the head has projections for generating a clearance between the bottom surface of the head and an opposing surface of the patch electrode and the clearance is filled with a solder.

2. A patch antenna according to claim 1, wherein the projections are disposed at a plurality of positions apart from one another.

3. A patch antenna according to claim 2, wherein three of the projections are disposed at even circumferential intervals on the bottom surface of the head.

* * * * *